US007308403B2

(12) United States Patent
Kim

(10) Patent No.: US 7,308,403 B2
(45) Date of Patent: Dec. 11, 2007

(54) COMPENSATION FOR UTTERANCE DEPENDENT ARTICULATION FOR SPEECH QUALITY ASSESSMENT

(75) Inventor: Doh-Suk Kim, Basking Ridge, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 807 days.

(21) Appl. No.: 10/186,862

(22) Filed: Jul. 1, 2002

(65) Prior Publication Data

US 2004/0002857 A1 Jan. 1, 2004

(51) Int. Cl.
*G10L 11/00* (2006.01)

(52) U.S. Cl. ..... 704/250; 704/200.1

(58) Field of Classification Search ..... None
See application file for complete search history.

(56) References Cited

U.S. PATENT DOCUMENTS 3,971,034 A * 7/1976 Bell et al. ..... 346/33 R
5,313,556 A * 5/1994 Parra ..... 704/246
5,454,375 A * 10/1995 Rothenberg ..... 600/538
5,799,133 A * 8/1998 Hollier et al. ..... 706/25
5,848,384 A * 12/1998 Hollier et al. ..... 704/231
6,035,270 A * 3/2000 Hollier et al. ..... 704/202
6,052,662 A * 4/2000 Hogden ..... 704/256.2
6,246,978 B1 * 6/2001 Hardy ..... 704/201
6,609,092 B1 * 8/2003 Ghitza et al. ..... 704/226
7,024,352 B2 * 4/2006 Beerends et al. ..... 704/200.1
7,165,025 B2 * 1/2007 Kim ..... 704/206
2004/0002852 A1 * 1/2004 Kim ..... 704/205
2004/0267523 A1 * 12/2004 Kim ..... 704/205

* cited by examiner

*Primary Examiner*—Donald L. Storm

(57) ABSTRACT

A method for objective speech quality assessment that accounts for phonetic contents, speaking styles or individual speaker differences by distorting speech signals under speech quality assessment. By using a distorted version of a speech signal, it is possible to compensate for different phonetic contents, different individual speakers and different speaking styles when assessing speech quality. The amount of degradation in the objective speech quality assessment by distorting the speech signal is maintained similarly for different speech signals, especially when the amount of distortion of the distorted version of speech signal is severe. Objective speech quality assessment for the distorted speech signal and the original undistorted speech signal are compared to obtain a speech quality assessment compensated for utterance dependent articulation.

20 Claims, 3 Drawing Sheets

40

COMPENSATION FOR UTTERANCE DEPENDENT ARTICULATION FOR SPEECH QUALITY ASSESSMENT

FIELD OF THE INVENTION

The present invention relates generally to communications systems and, in particular, to speech quality assessment.

BACKGROUND OF THE RELATED ART

Performance of a wireless communication system can be measured, among other things, in terms of speech quality. In the current art, there are two techniques of speech quality assessment. The first technique is a subjective technique (hereinafter referred to as "subjective speech quality assessment"). In subjective speech quality assessment, human listeners are used to rate the speech quality of processed speech, wherein processed speech is a transmitted speech signal which has been processed at the receiver. This technique is subjective because it is based on the perception of the individual human, and human assessment of speech quality typically takes into account phonetic contents, speaking styles or individual speaker differences. Subjective speech quality assessment can be expensive and time consuming.

The second technique is an objective technique (hereinafter referred to as "objective speech quality assessment"). Objective speech quality assessment is not based on the perception of the individual human. Most objective speech quality assessment techniques are based on known source speech or reconstructed source speech estimated from processed speech. However, these objective techniques do not account for phonetic contents, speaking styles or individual speaker differences.

Accordingly, there exists a need for assessing speech quality objectively which takes into account phonetic contents, speaking styles or individual speaker differences.

SUMMARY OF THE INVENTION

The present invention is a method for objective speech quality assessment that accounts for phonetic contents, speaking styles or individual speaker differences by distorting speech signals under speech quality assessment. By using a distorted version of a speech signal, it is possible to compensate for different phonetic contents, different individual speakers and different speaking styles when assessing speech quality. The amount of degradation in the objective speech quality assessment by distorting the speech signal is maintained similarly for different speech signals, especially when the amount of distortion of the distorted version of speech signal is severe. Objective speech quality assessment for the distorted speech signal and the original undistorted speech signal are compared to obtain a speech quality assessment compensated for utterance dependent articulation. In one embodiment, the comparison corresponds to a difference between the objective speech quality assessments for the distorted and undistorted speech signals.

BRIEF DESCRIPTION OF THE DRAWINGS

The features, aspects, and advantages of the present invention will become better understood with regard to the following description, appended claims, and accompanying drawings where:

DETAILED DESCRIPTION

The present invention is a method for objective speech quality assessment that accounts for phonetic contents, speaking styles or individual speaker differences by distorting processed speech. Objective speech quality assessment tend to yield different values for different speech signals which have same subjective speech quality scores. The reason these values differ is because of different distributions of spectral contents in the modulation spectral domain. By using a distorted version of a processed speech signal, it is possible to compensate for different phonetic contents, different individual speakers and different speaking styles. The amount of degradation in the objective speech quality assessment by distorting the speech signal is maintained similarly for different speech signals, especially when the distortion is severe. Objective speech quality assessment for the distorted speech signal and the original undistorted speech signal are compared to obtain a speech quality assessment compensated for utterance dependent articulation.

Figure 1:
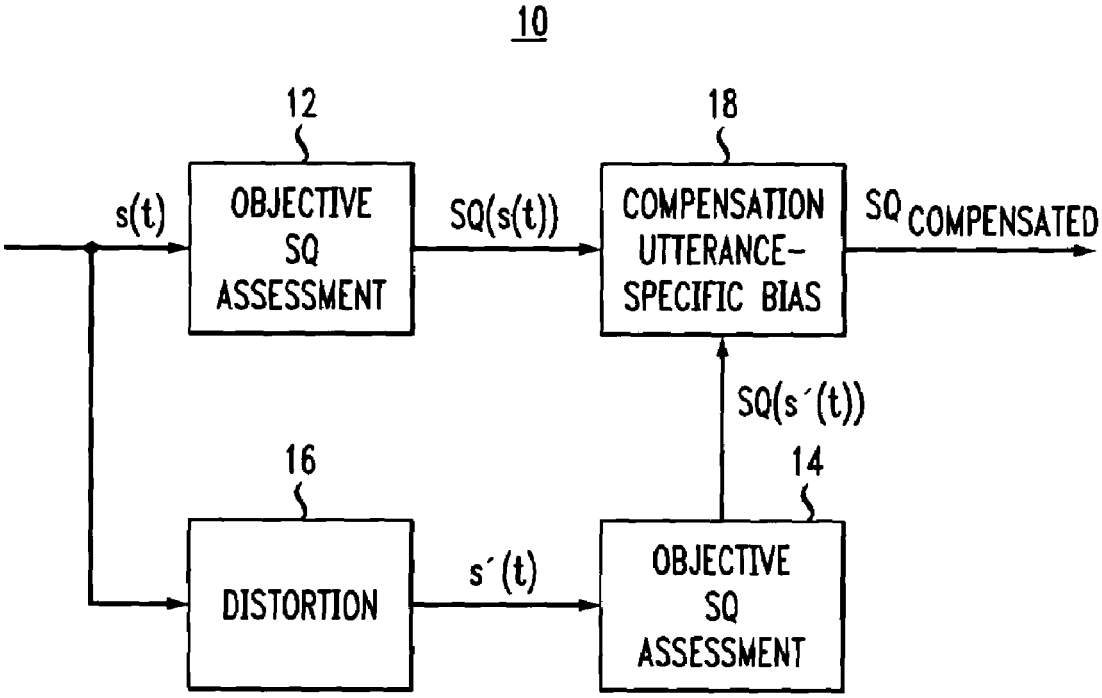
FIG. 1 depicts an objective speech quality assessment arrangement which compensates for utterance dependent articulation in accordance with the present invention.

FIG. 1 depicts an objective speech quality assessment arrangement 10 which compensates for utterance dependent articulation in accordance with the present invention. Objective speech quality assessment arrangement 10 comprises a plurality of objective speech quality assessment modules 12, 14, a distortion module 16 and a compensation utterance-specific bias module 18. Speech signal s(t) is provided as inputs to distortion module 16 and objective speech quality assessment module 12. In distortion module 16, speech signal s(t) is distorted to produce a modulated noise reference unit (MNRU) speech signal s'(t). In other words, distortion module 16 produces a noisy version of input signal s(t). MNRU speech signal s'(t) is then provided as input to objective speech quality assessment module 14.

In objective speech quality assessment modules 12, 14, speech signal s(t) and MNRU speech signal s'(t) are processed to obtain objective speech quality assessments SQ(s(t) and SQ(s'(t)). Objective speech quality assessment modules 12, 14 are essentially identical in terms of the type of processing performed to any input speech signals. That is, if both objective speech quality assessment modules 12, 14 receive the same input speech signal, the output signals of both modules 12, 14 would be approximately identical. Note that, in other embodiments, objective speech quality assessment modules 12, 14 may process speech signals s(t) and s'(t) in a manner different from each other. Objective speech quality assessment modules are well-known in the art. An example of such a module will be described later herein.

Objective speech quality assessments SQ(s(t) and SQ(s'(t)) are then compared to obtain speech quality assessment $SQ_{compensated}$, which compensates for utterance dependent articulation. In one embodiment, speech quality assessment $SQ_{compensated}$ is determined using the difference between objective speech quality assessments SQ(s(t) and SQ(s'(t)). For example, $SQ_{compensated}$ is equal to SQ(s(t) minus SQ(s'(t)), or vice-versa. In another embodiment, speech quality assessment $SQ_{compensated}$ is determined based on a ratio between objective speech quality assessments SQ(s(t) and SQ(s'(t)). For example, $$SQ_{compensated} = \frac{SQ(s(t)) + \mu}{SQ(s'(t)) + \mu} \quad \text{or} \quad SQ_{compensated} = \frac{SQ(s'(t)) + \mu}{SQ(s(t)) + \mu}$$

where μ is a small constant value.

Figure 2:
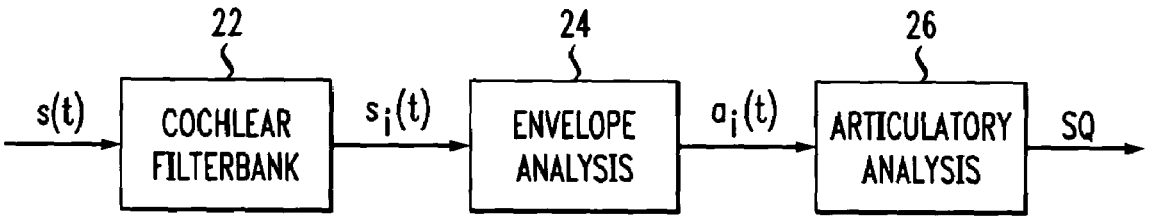
FIG. 2 depicts an embodiment of an objective speech quality assessment module employing an auditory-articulatory analysis module in accordance with the present invention.

As mentioned earlier, objective speech quality assessment modules 12, 14 are well known in the art. FIG. 2 depicts an embodiment 20 of an objective speech quality assessment module 12, 14 employing an auditory-articulatory analysis module in accordance with the present invention. As shown in FIG. 2, objective quality assessment module 20 comprises of cochlear filterbank 22, envelope analysis module 24 and articulatory analysis module 26. In objective quality assessment module 20, speech signal s(t) is provided as input to cochlear filterbank 22. Cochlear filterbank 22 comprises a plurality of cochlear filters $h_i(t)$ for processing speech signal s(t) in accordance with a first stage of a peripheral auditory system, where $i=1,2,\ldots,N_c$ represents a particular cochlear filter channel and $N_c$ denotes the total number of cochlear filter channels. Specifically, cochlear filterbank 22 filters speech signal s(t) to produce a plurality of critical band signals $s_i(t)$, wherein critical band signal $s_i(t)$ is equal to $s(t)*h_i(t)$.

The plurality of critical band signals $s_i(t)$ is provided as input to envelope analysis module 24. In envelope analysis module 24, the plurality of critical band signals $s_i(t)$ is processed to obtain a plurality of envelopes $a_i(t)$, wherein $a_i(t)=\sqrt{s_i^2(t)+\hat{s}_i^2(t)}$ and $\hat{s}_i(t)$ is the Hilbert transform of $s_i(t)$.

The plurality of envelopes $a_i(t)$ is then provided as input to articulatory analysis module 26. In articulatory analysis module 26, the plurality of envelopes $a_i(t)$ is processed to obtain a speech quality assessment for speech signal s(t). Specifically, articulatory analysis module 26 does a comparison of the power associated with signals generated from the human articulatory system (hereinafter referred to as "articulation power $P_A(m,i)$") with the power associated with signals not generated from the human articulatory system (hereinafter referred to as "non-articulation power $P_{NA}(m,i)$"). Such comparison is then used to make a speech quality assessment.

Figure 3:
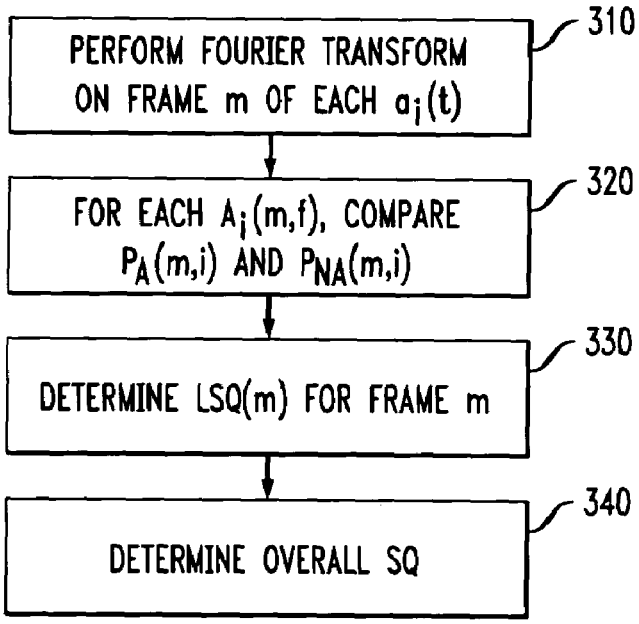
FIG. 3 depicts a flowchart for processing, in an articulatory analysis module, the plurality of envelopes $a_i(t)$ in accordance with one embodiment of the invention.

FIG. 3 depicts a flowchart 300 for processing, in articulatory analysis module 26, the plurality of envelopes $a_i(t)$ in accordance with one embodiment of the invention. In step 310, Fourier transform is performed on frame m of each of the plurality of envelopes $a_i(t)$ to produce modulation spectrums $A_i(m,f)$, where f is frequency.

Figure 4:
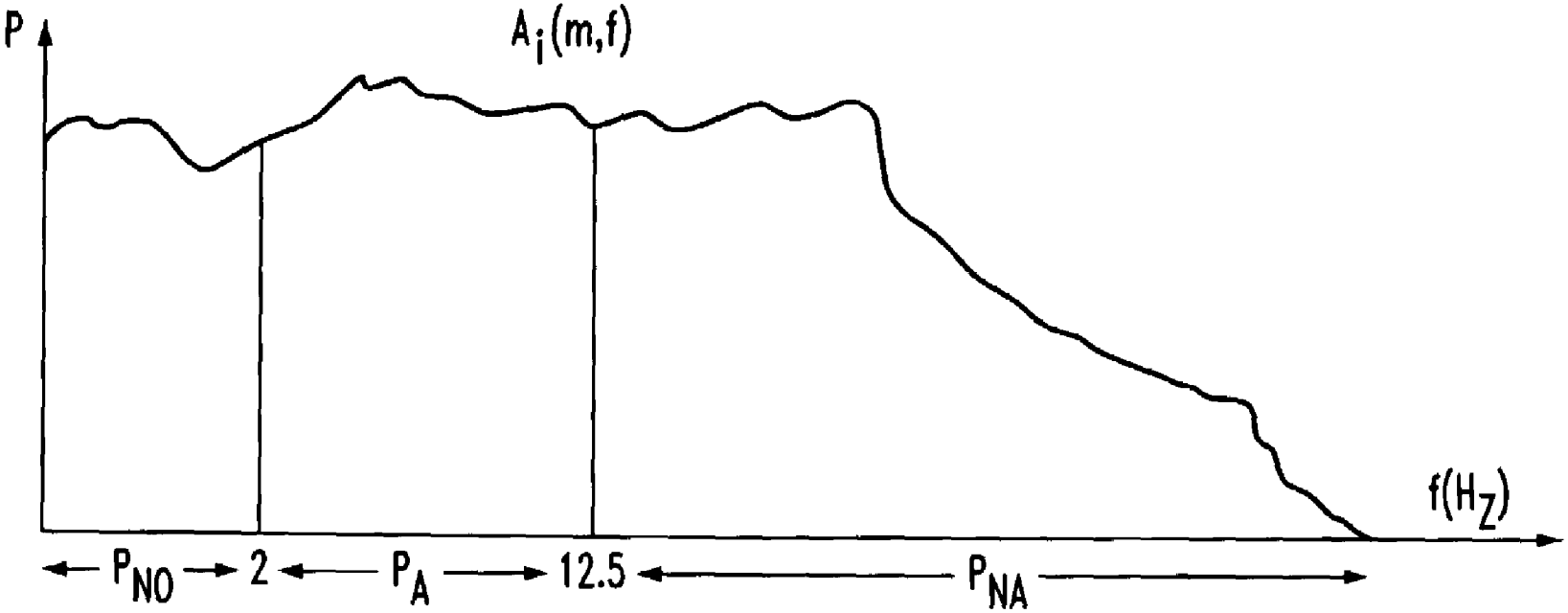
FIG. 4 depicts an example illustrating a modulation spectrum $A_i(m,f)$ in terms of power versus frequency.

FIG. 4 depicts an example 40 illustrating modulation spectrum $A_i(m,f)$ in terms of power versus frequency. In example 40, articulation power $P_A(m,i)$ is the power associated with frequencies 2~12.5 Hz, and non-articulation power $P_{NA}(m,i)$ is the power associated with frequencies greater than 12.5 Hz. Power $P_{No}(m,i)$ associated with frequencies less than 2 Hz is the DC-component of frame m of critical band signal $a_i(t)$. In this example, articulation power $P_A(m,i)$ is chosen as the power associated with frequencies 2~12.5 Hz based on the fact that the speed of human articulation is 2~12.5 Hz, and the frequency ranges associated with articulation power PA(m,i) and non-articulation power $P_{NA}(m,i)$ (hereinafter referred to respectively as "articulation frequency range" and "non-articulation frequency range") are adjacent, non-overlapping frequency ranges. It should be understood that, for purposes of this application, the term "articulation power $P_A(m,i)$" should not be limited to the frequency range of human articulation or the aforementioned frequency range 2~12.5 Hz. Likewise, the term "non-articulation power $P_{NA}(m,i)$" should not be limited to frequency ranges greater than the frequency range associated with articulation power $P_A(m,i)$. The non-articulation frequency range may or may not overlap with or be adjacent to the articulation frequency range. The non-articulation frequency range may also include frequencies less than the lowest frequency in the articulation frequency range, such as those associated with the DC-component of frame m of critical band signal $a_i(t)$.

In step 320, for each modulation spectrum $A_i(m,f)$, articulatory analysis module 26 performs a comparison between articulation power $P_A(m,i)$ and non-articulation power $P_{NA}(m,i)$. In this embodiment of articulatory analysis module 26, the comparison between articulation power $P_A(m,i)$ and non-articulation power $P_{NA}(m,i)$ is an articulation-to-non-articulation ratio ANR(m,i). The ANR is defined by the following equation $$ANR(m, i) = \frac{P_A(m, i) + \varepsilon}{P_{NA}(m, i) + \varepsilon} \qquad \text{equation (1)}$$

where ε is some small constant value. Other comparisons between articulation power $P_A(m,i)$ and non-articulation power $P_{NA}(m,i)$ are possible. For example, the comparison may be the reciprocal of equation (1), or the comparison may be a difference between articulation power $P_A(m,i)$ and non-articulation power $P_{NA}(m,i)$. For ease of discussion, the embodiment of articulatory analysis module 26 depicted by flowchart 300 will be discussed with respect to the comparison using ANR(m,i) of equation (1). This should not, however, be construed to limit the present invention in any manner.

In step 330, ANR(m,i) is used to determine local speech quality LSQ(m) for frame m. Local speech quality LSQ(m) is determined using an aggregate of the articulation-to-non-articulation ratio ANR(m,i) across all channels i and a weighing factor R(m,i) based on the DC-component power $P_{No}(m,i)$. Specifically, local speech quality LSQ(m) is determined using the following equation $$LSQ(m) = \log\left[\sum_{i=1}^{N_c} ANR(m, i)R(m, i)\right] \qquad \text{equation (2)}$$

where $$R(m, i) = \frac{\log(1 + P_{No}(m, i)}{\sum_{k=1}^{N_c} \log(1 + P_{No}(m, k)} \qquad \text{equation (3)}$$

and k is a frequency index.

In step 340, overall speech quality SQ for speech signal s(t) is determined using local speech quality LSQ(m) and a log power $P_s(m)$ for frame m. Specifically, speech quality SQ is determined using the following equation $$SQ = L\{P_s(m)LSQ(m)\}_{m=1}^{T} = \left[\sum_{\substack{m=1 \\ P_s > P_{th}}}^{T} P_s^{\lambda}(m)LSQ^{\lambda}(m)\right]^{\frac{1}{\lambda}} \quad \text{equation (4)}$$

where $$P_s(m) = \log\left[\sum_{t \in m} s^2(t)\right],$$

L is $L_p$-norm, T is the total number of frames in speech signal s(t), λ is any value, and $P_{th}$ is a threshold for distinguishing between audible signals and silence. In one embodiment, λ is preferably an odd integer value.

The output of articulatory analysis module 26 is an assessment of speech quality SQ over all frames m. That is, speech quality SQ is a speech quality assessment for speech signal s(t).

Although the present invention has been described in considerable detail with reference to certain embodiments, other versions are possible. Therefore, the spirit and scope of the present invention should not be limited to the description of the embodiments contained herein.

I claim:

1. A method of assessing speech quality comprising the steps of:

determining first and second speech quality assessments for first and second speech signals, respectively, the second speech signal being a processed speech signal, and the first speech signal being a distorted version of the second speech signal; and comparing the first and second speech quality assessments to obtain a compensated speech quality assessment.

2. The method of claim 1 comprising the additional step of:

prior to determining the first and second speech quality assessments, distorting the second speech signal to produce the first speech signal.

3. The method of claim 1, wherein the first and second speech quality assessments are determined using an identical technique for objective speech quality assessment.

4. The method of claim 1, wherein the compensated speech quality assessment corresponds to a difference between the first and second speech quality assessments.

5. The method of claim 1, wherein the compensated speech quality assessment corresponds to a ratio between the first and second speech quality assessments.

6. The method of claim 1 , wherein the first and second speech quality assessments are determined using auditory-articulatory analysis.

7. The method of claim 1, wherein the step of determining the first and second speech quality assessments comprises the steps of:

comparing articulation power and non-articulation power for the first or second speech signal, wherein the articulation and non-articulation powers are powers associated with articulation and non-articulation frequencies of the first or second speech signal; and determining the second or first speech quality assessments based on the comparison between the articulation power and non-articulation power.

8. The method of claim 7, wherein the articulation frequencies are approximately 2~12.5 Hz.

9. The method of claim 7, wherein the articulation frequencies correspond approximately to a speed of human articulation.

10. The method of claim 7, wherein the non-articulation frequencies are approximately greater than the articulation frequencies.

11. The method of claim 7, wherein the comparison between the articulation power and non-articulation power is a ratio between the articulation power and non-articulation power.

12. The method of claim 11, wherein the ratio includes a denominator and numerator, the numerator including the articulation power and a small constant, the denominator including the non-articulation power plus the small constant.

13. The method of claim 7, wherein the comparison between the articulation power and non-articulation power is a difference between the articulation power and non-articulation power.

14. The method of claim 7, wherein the step of determining the first and second speech quality assessments includes the step of:

determining a local speech quality using the comparison between the articulation power and non-articulation power.

15. The method of claim 14, wherein the local speech quality is further determined using a weighing factor based on a DC-component power.

16. The method of claim 14, wherein the first or second speech quality assessment is determined using the local speech quality.

17. The method of claim 7, wherein the step of comparing the articulation power and the non-articulation power includes the step of: performing a Fourier transform on each of a plurality of envelopes obtained from a plurality of critical band signals.

18. The method of claim 7, wherein the step of comparing articulation power and non-articulation power includes the step of:

filtering the first or second speech signal to obtain a plurality of critical band signals.

19. The method of claim 18, wherein the step of comparing the articulation power and the non-articulation power includes the step of:

performing an envelope analysis on the plurality of critical band signals to obtain a plurality of modulation spectrums.

20. The method of claim 19, wherein the step of comparing the articulation power and the non-articulation power includes the step of:

performing a Fourier transform on each of the plurality of modulation spectrums.

* * * * *